United States Patent [19]

Wortham et al.

[11] 4,081,975

[45] Apr. 4, 1978

[54] CLOTHES WASHER WITH CENTERPOST MOUNTED LINT FILTER BAG

[75] Inventors: Otis W. Wortham, Springfield; John A. Sundstrom, Springboro, both of Ohio

[73] Assignee: General Motors Corporation, Detroit, Mich.

[21] Appl. No.: 790,075

[22] Filed: Apr. 22, 1977

[51] Int. Cl.[2] ..... D06F 39/10

[52] U.S. Cl. ..... 68/18 FA

[58] Field of Search ..... 68/18 FA

[56] References Cited

U.S. PATENT DOCUMENTS

| | | | |
|---|---|---|---|
| 2,498,894 | 2/1950 | McCormick et al. | 68/18 FA X |
| 2,642,733 | 6/1953 | McCormick et al. | 68/18 FA X |
| 2,942,444 | 6/1960 | Abresch | 68/18 FA X |
| 3,111,831 | 11/1963 | Tope et al. | 68/18 FA |
| 3,275,143 | 9/1966 | Bochan | 68/18 F X |
| 3,330,135 | 7/1967 | Douglas | 68/18 FA |
| 3,769,818 | 11/1973 | Smith | 68/18 F |

*Primary Examiner*—Philip R. Coe

*Attorney, Agent, or Firm*—Edward P. Barthel

[57] ABSTRACT

A self-compacting lint filter for a domestic clothes washer is mounted on a rotatable and vertically reciprocal agitator for movement therewith. The filter is in the form of an elongated mesh bag which extends axially into the hollow of the agitator upstanding centerpost. Re-circulating wash water is conveyed to a nozzle which directs the flow with its entrained lint through the mesh bag. The vertical reciprocation of the agitator provides relative motion between the flow and the bag filtering lint from the water while the shaking of the bag causes the bag to fold upon itself to self-clean collected lint from the sidewall of the bag whereby the lint is aggregated into an easily removable wad at the bottom of the bag.

3 Claims, 7 Drawing Figures

CLOTHES WASHER WITH CENTERPOST MOUNTED LINT FILTER BAG

This invention relates to a reciprocating type domestic clothes washer and, more particularly, to an improved lint filter therefor.

The prior art teaches the use of lint filters for washers having vertically reciprocating agitators in which lint is removed from the recirculating washing liquid by pumping liquid in one direction through a filter which may be located adjacent the access opening as shown in U.S. Pat. No. 3,769,818, issued Nov. 6, 1973 to Roy R. Smith, and assigned to the assignee of the instant application. The prior art is also replete with oscillating type agitators having centerpost mounted lint filter screens. Two examples are U.S. Pat. No. 3,111,831 to P. H. Tope, et al, and U.S. Pat. No. 3,724,242 to G. J. Davis. In these patents the oscillating action of the agitator causes fluid flow through a rigid filter screen on the agitator centerpost to effect a filtering treatment of the fluid.

Accordingly, it is an object of this invention to provide an improved agitator mounted self-compacting lint filter for a reciprocating type clothes washer with the filter in the form of a mesh bag positioned in an easily accessible and removable position within the open top cavity of the agitator centerpost.

It is another object of the present invention to provide an improved fine mesh bag lint filter for a domestic clothes washing machine having a vertically reciprocable agitator, which bag extends axially into the open top cavity of the agitator centerpost, whereby recirculating liquid is directed by a nozzle into the bag top opening for flow through the mesh bag into the agitator centerpost, with any lint or dirt carried by the liquid being retained in the mesh bag. The relative vertical motion between the liquid flow and the bag, together with the bag axially folding upon itself during each vertical cycle of the agitator, acts to self-clean the bag side walls of contaminants. Also the shaking of the bag causes the lint to be compacted into a wad in the bottom wall portion of the bag for easy disposal.

Further objects and advantages of the present invention will be apparent from the following description reference being had to the accompanying drawings, wherein preferred embodiments of the present invention are clearly shown.

Figure 1:
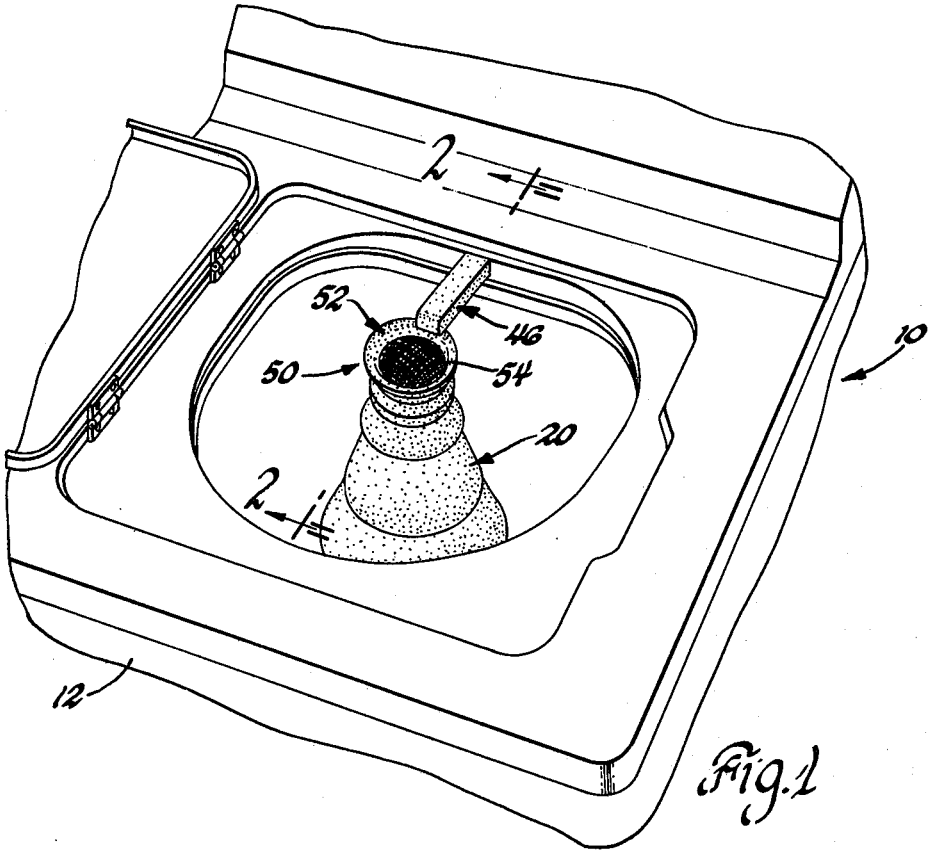
FIG. 1 is a fragmentary perspective view of a domestic clothes washing machine to illustrate the location of the filter.
Figure 2:
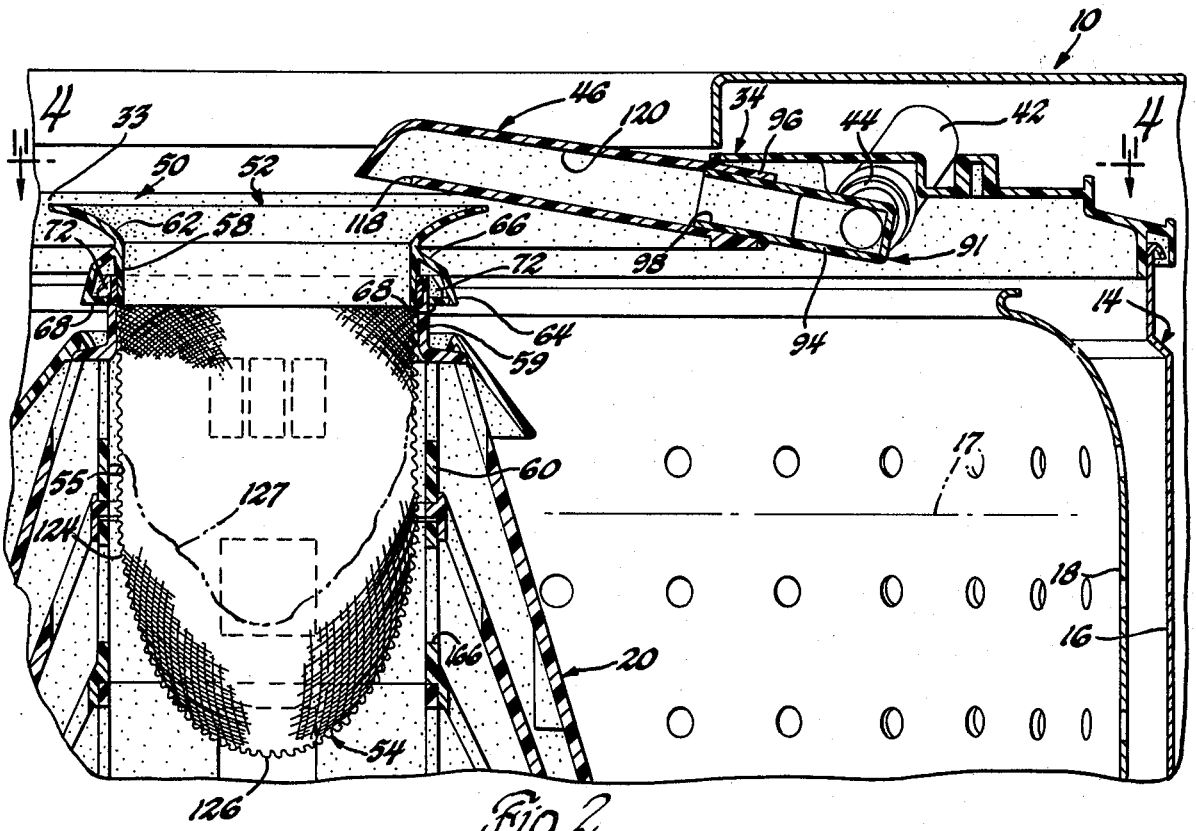
FIG. 2 is a fragmentary sectional view taken along line 2—2 in FIG. 1, to show a first embodiment of the invention.
Figure 3:
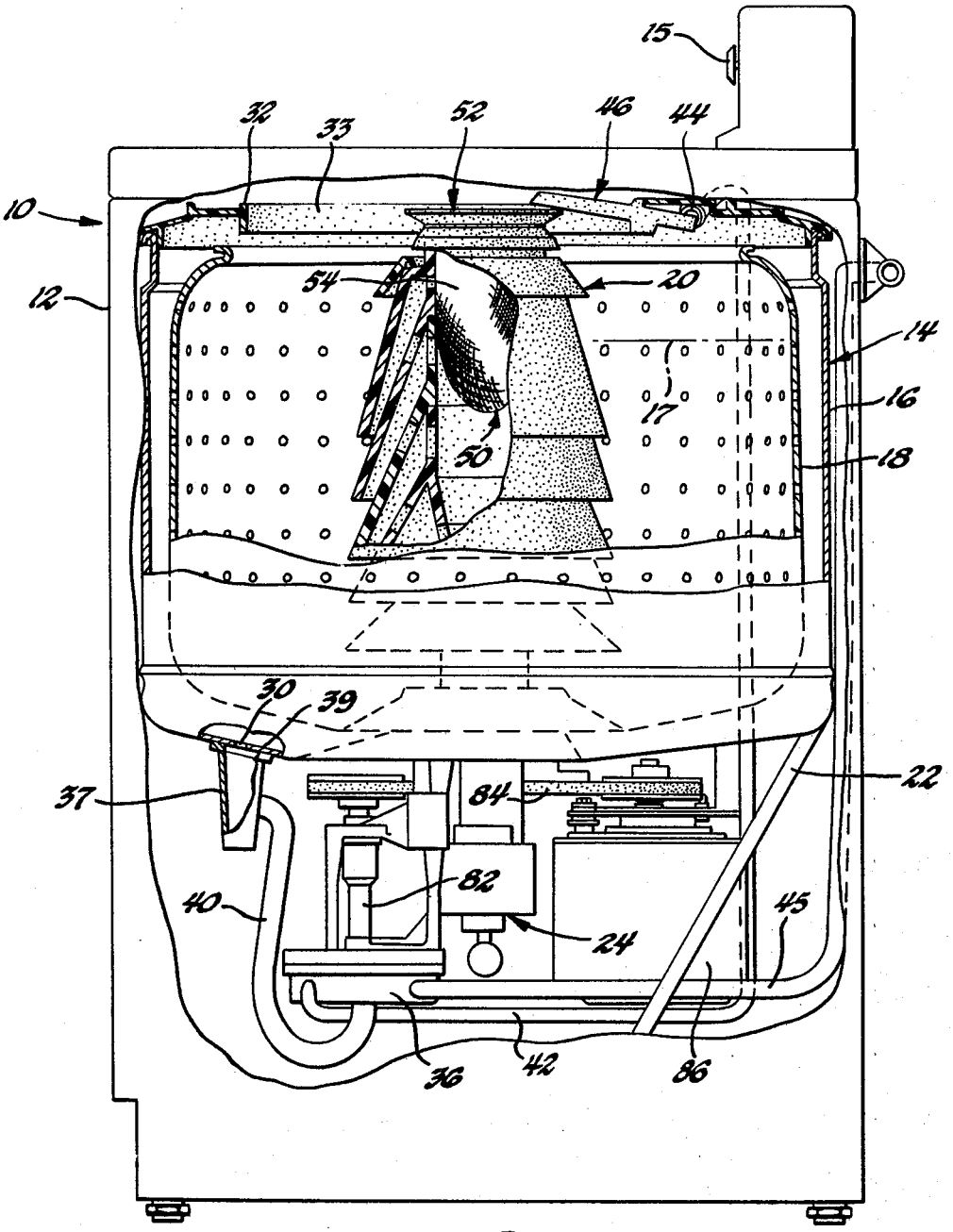
FIG. 3 is a side elevational view, partly in section, of a domestic clothes washer incorporating this invention.

With reference now to FIGS. 1-3, the environment of this invention in a domestic clothes washer 10 will now be described. The clothes washer includes a cabinet 12 enclosing a tub assembly 14 and a timer 15 for controlling an automatic clothes washing cycle. The tub assembly includes an imperforate outer water container 16 adapted to contain a level of washing liquid 17 and a perforate spin basket 18 therein. An agitator 20 is disposed within the spin basket 18 for agitating the clothes during a clothes washing cycle.

The tub assembly 14 is mounted on a suspension system shown generally at 22 in FIG. 3 and more fully taught in U.S. Pat. No. 3,493,118, granted Feb. 3, 1970. The agitator 20 and the spin basket 18 are connected to a drive mechanism shown generally at 24. The drive mechanism may be of a roller drive type taught more fully in U.S. Pat. No. 3,087,321, granted Apr. 30, 1963. In general mechanism 24 may be operated in one manner to vertically reciprocate or oscillate the agitator 20 for washing clothes in the tub assembly. When the mechanism is operated in another manner, the spin basket 18 is rotated with respect to the water container 16 for centrifuging water from the clothes in the spin basket.

The water recirculation system, shown in FIG. 3, will now be described. The water container 16 includes a bottom outlet 30 and ring 32 defining an open top access opening 33. A lower combined recirculating and drain pump 36 withdraws washing water or liquid from the water container 16 through the bottom outlet 30 into a pressure fill sump 37, joined to the bottom 39 of container 16 so as to be in communication with the outlet 30. The water, picked up from the pressure fill sump 37 by sump hose 40, is pumped up to the subtop 34 by means of recirculation supply hose 42. In this way washing liquid is returned to the water container via hose 42 which has its outlet 44 suitably connected to recirculating nozzle 46 designed for washing systems having flow rates of the order of five to twenty gallons per minute.

The recirculation pump 36 only operates during the wash and rinse cycle of the washer. The purpose of recirculation is to remove lint and other sediment or particulate matter from the recirculating washing liquid. For this purpose, an improved lint filter assembly shown generally at 50 in FIG. 2 is provided. The lint filter assembly 50 includes a support member 52 and an elongated mesh bag 54. The member 52 is preferably molded of plastic material such as Noryl and includes a sleeve 58 extending downwardly so as to telescope into collar 59 of agitator centerpost 60. The support member 52 has a radially outwardly extending flange 62 having an arcuate truncated conical section which increases upwardly in cross sectional area. Disposed circumjacent the collar 59 is a clamping ring in the form of a downwardly divergent skirt 64 integral with a frustoconical shaped flange 66. The skirt 64 has a pair of inwardly directed opposed retaining tongues 68 which slidably engage complementary mating lugs 72 having inclined upper surfaces to bear upon the corresponding lower surfaces of lugs 72 to provide a bayonette-type connection.

It is apparent, when it is desired to remove the filter assembly 50 from the centerpost 60 for cleaning, or the like, it is merely necessary to rotate the member 52 relative to the centerpost collar 59 a few degrees to disengage the lugs 72 from the tongues 68. The mesh bag 54 is preferably formed of plastic screen material which in the disclosed embodiment is composed of a polyester fabric screen having a 68 × 72 mesh and a burst strength of about 55 pounds minimum. The upper periphery of the bag 54 is integrally molded on the inner surface of sleeve 58 such that upon securing the support member 52 in place on the centerpost the mesh bag depends freely into the cavity 55 in an unobstructed manner with its bottom wall portion positioned as shown below the level of washing liquid 17.

The drain system for the clothes washer includes the drain pump 36 for pumping washing liquid from the water container 16 through its bottom outlet 30 into sump 37 and by means of drain conduits or hoses 40 and 45 to a remote drain. The pump 36 is operated by reversible power shaft 82. The shaft 82 is driven by a belt takeoff 84 from a reversible motor 86 of drive mechanism 24. When the drive mechanism is operating in a manner to reciprocate the agitator 20, the power shaft 82 is rotated in a direction to cause the pump 36 to recirculate washing liquid from its single outlet through hose 88 to recirculator nozzle member 45. When the drive mechanism 24 is operating in a manner to rotate the spin basket in a centrifuging operation, the power shaft is rotated in the same direction to cause the pump 36 to pump to drain via hose 42.

Figure 4:
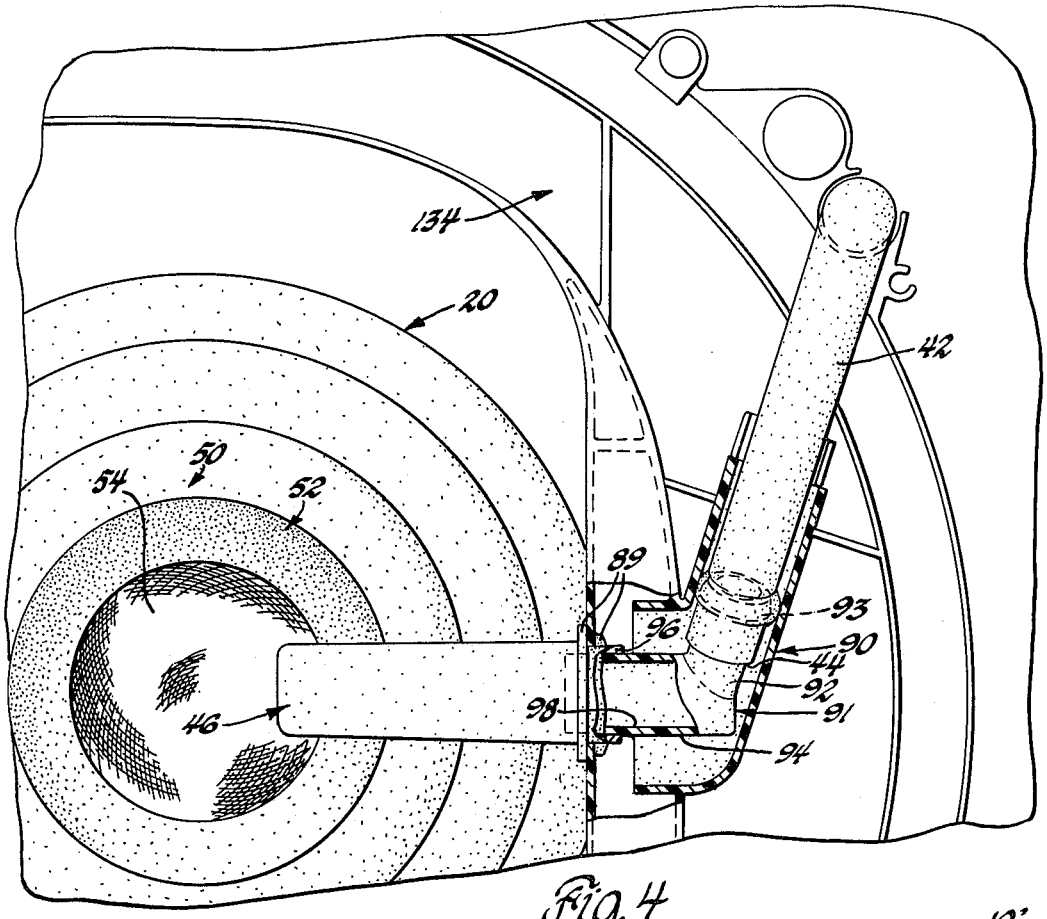
FIG. 4 is a fragmentary top elevational view, partly in section, taken on the line 4—4 of FIG. 2.

Turning now to FIGS. 3 and 4, the nozzle member 46 is removably secured to the underside of the washer subtop 34 by suitable means such as interlocking flanges 89 and screws (not shown). The supply hose outlet 44 projects into an upwardly sloped oblique pod 90 integrally molded on the underside of subtop 34. An angled transition duct 91 of conveniently molded plastic, has an upstream tubular end 92 formed with a peripheral collar 93 for press fit insertion into the hose outlet 44 such that the tubular end 92 is conveniently inserted into the hose with the collar 93 of sufficient size to prevent overinsertion. The transition duct 91 has an integral elbow formed with a rectangular sectioned stub conduit 94 inserted into conforming nozzle inlet hub 96 such that the duct interior passage 98 transmits liquid to the nozzle 46. The outlet 118 of nozzle rectangular sectioned passage 120 is over the top opening of the centerpost 60 whereby recirculating liquid introduced into the conduit flows out through the outlet opening 118 into the center portion of the mesh bag 54. The nozzle conduit 120 acts in a manner to straighten and soften the flow of recirculating liquid to prevent its aeration while directing the liquid flow through the mesh bag 54 as the agitator 20 reciprocates thereby to remove contaminants from the recirculating liquid and depositing them on the sidewall portion 124 of the elongated open top bag 54.

The vertical shaking of the fine mesh bag 54 effected by the reciprocation of the agitator 20 and the flow of the recirculating liquid through the bag 54 cooperate to force and flush the deposited contaminants, such as dirt and lint, downwardly thereby to self-clean the bag sidewall portion 124. Thus, by virtue of the vertical shaking and flow of recirculating water, the contaminants are forced and flushed from the sidewall portion 124 so as to be compacted into a wad in the bag bottom wall portion 126 for easy manual disposal thereof through the open top of the agitator. It will be noted that the wad of lint may have a generally ball or rope configuration depending upon the particular shape of the bottom wall portion 126 of the filter bag.

It will be appreciated that because the lint filter bag 54 is a web-like member, which in the preferred form is a polyester screen, each vertical reciprocation of the agitator causes a delay in its vertical travel relative to the centerpost. That is, at the instant in time that the agitator 20 begins its upward travel the bag 54 is at some intermediate position, indicated by dot-dashed line 127, attempting to complete its downward movement to the fully extended position shown in FIG. 2. It will thus be appreciated that there is an inertia induced time lag between the bag 54 and the agitator causing relative motion therebetween. The result of this relative motion between the bag and the agitator causes the bag to fold upon itself along its vertical axis during each vertical stroke or cycle of the agitator. As a consequence a snapping or shaking action is imparted to the bag upon each oscillation or reciprocation of the agitator. This snapping or shaking of the bag, together with the water flow from nozzle opening 118, causes the contaminants such as lint and dirt to be aggregated into easily removable wads or balls at the bottom of the bag.

Figure 5:
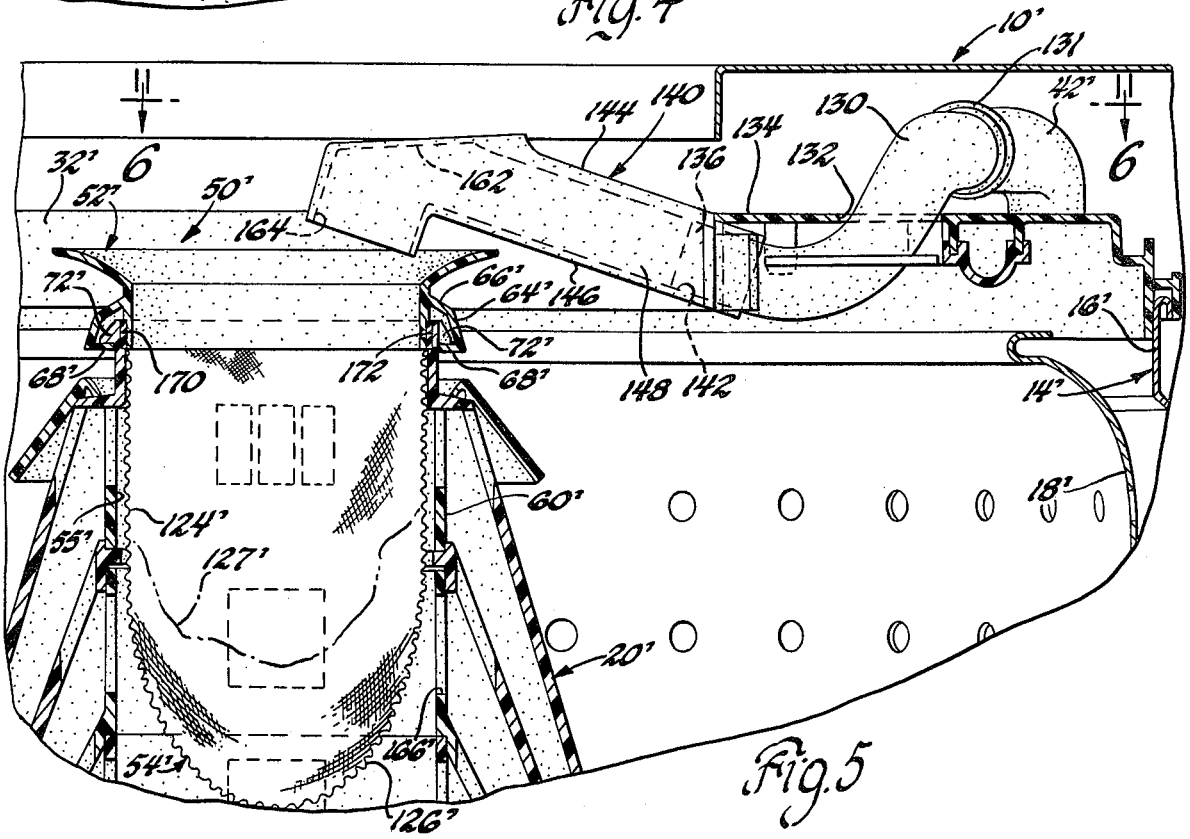
FIG. 5 is a view similar to FIG. 2 of a second embodiment of the invention.
Figure 6:
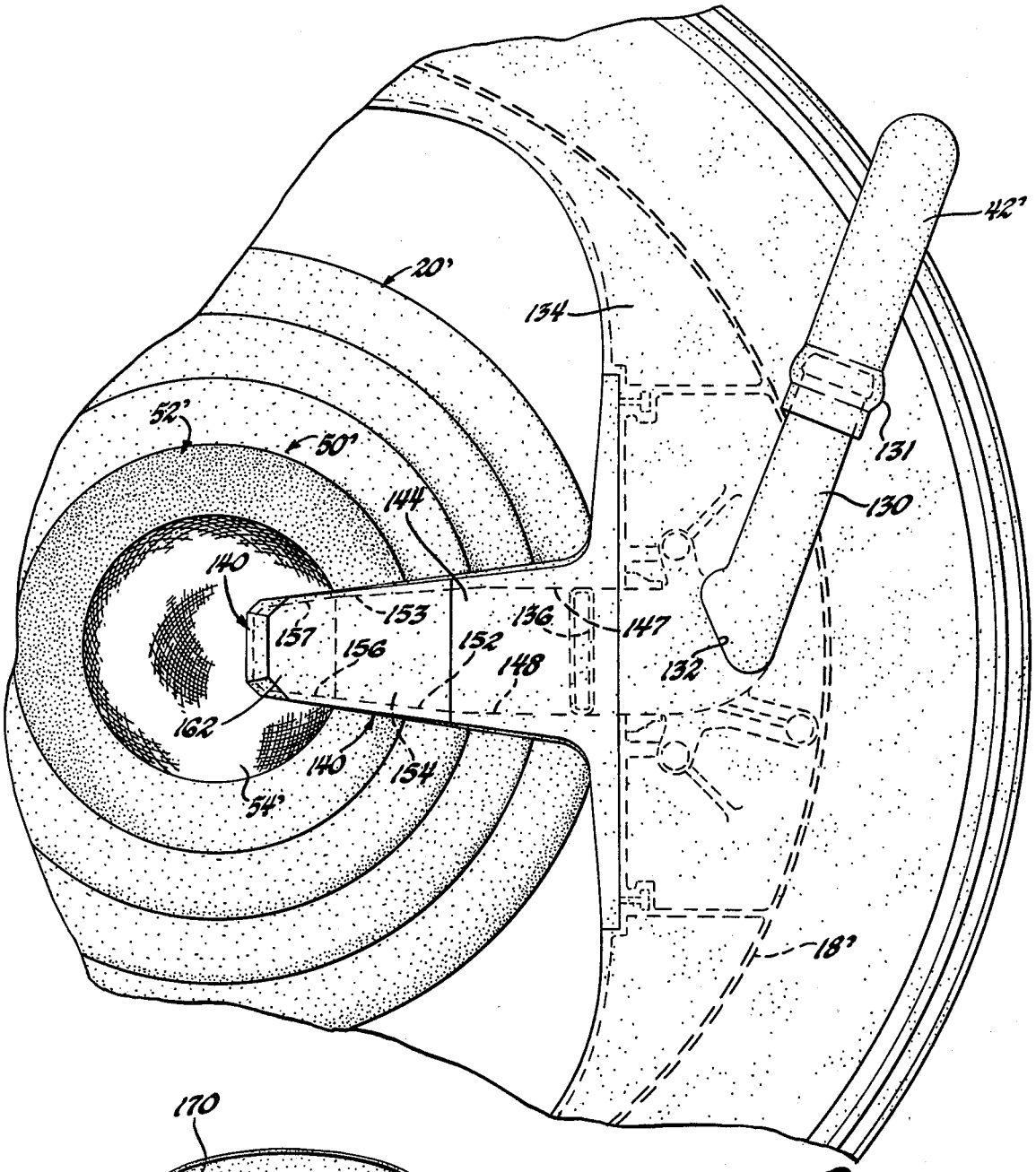
FIG. 6 is a view taken on line 6—6 of FIG. 5.
Figure 7:
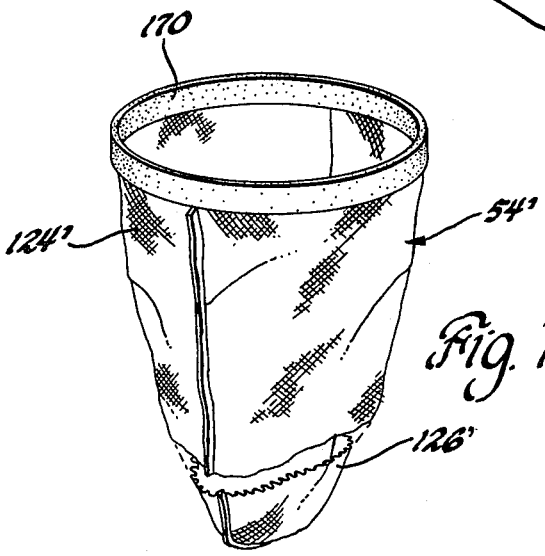
FIG. 7 is a perspective view of the filter of FIG. 5.

FIGS. 5, 6 and 7 disclose a second embodiment of the invention. The same reference numerals with primes added have been used to designate corresponding elements of the clothes washer in FIGS. 1–4 and, unless otherwise indicated, the primed elements shown in FIGS. 5–7 function in the same manner as corresponding elements shown in FIGS. 1–4.

In this second embodiment of the filter, a nozzle adapter 130 includes a tubular connector portion with its inlet attached at separable joint 131 to the outlet of hose 42'. As viewed in FIG. 5, adapter 130 is formed in a downwardly bowed or curved manner so as to extend through aperture 132 in horizontal plate portion of subtop 134 integrally molded with the ring 32'. The nozzle adapter 130 terminates in an upwardly sloped elongated sectioned outlet 136 telescoped within the inlet of recirculator nozzle member 140 oriented at the same upwardly sloped angle.

The nozzle member 140 includes an inlet 142 having a generally rectangular configuration to properly connect to the outlet of connector 130. Downstream of the inlet 142, the nozzle 140 is formed from a top wall 144 and a bottom wall 146 which are substantially parallel together with three sets of side walls. As seen in FIG. 6, the first of these sets of side walls 147 and 148 are substantially parallel. Downstream of the inlet 142 the second set of side walls 152 and 153 converge to form a restricted chamber 154. A third set of side walls 156 and 157 converge at a greater angle and cooperate with downstream converging top wall 162 to form a contoured flow path conduit communicating with downwardly and inwardly directed nozzle outlet opening 164.

The nozzle outlet opening 164, like the first embodiment of FIGS. 1–4, is oriented with respect to the top opening of the filter bag 54' so that recirculating liquid is directed toward the center portion thereof in a free fall manner to minimize aeration. The nozzle 140 acts in a manner to straighten and soften the flow of recirculating liquid to prevent aeration while directing the flow through the mesh bag 54' as the agitator 20 reciprocates so as to remove contaminants from the recirculating liquid as described in the first embodiment. When the agitator 20' is reciprocated in the tub 18' currents of wash water will move out of the housing portion of centerpost 60 through ports 166' and be returned to the tub by the recirculation pump 36 in the same manner as the ports 166 of the first embodiment.

As best seen in FIGS. 5 and 7, the filter bag 54' is separable from its support member 52'. The bag 54' includes a ring 170 which is attached by suitable means to the upper periphery thereof. In the disclosed form the ring 170 is of plastic material with the polyester screen filter bag molded to the inner surface of the ring 170. A notched portion 172 is formed in the interior of the upper end of the agitator centerpost 60 dimensioned to removably receive the ring 170 therein. It will be appreciated that with this embodiment of the invention the filter bag 54' can be readily and economically replaced upon being damaged, worn out or the like.

At the top of the centerpost housing wall are diametrically opposite lugs 72' which serve as keeper means for latch tongues 68' integral with support member 52'. The tongues 68' are formed with tapered or ramp portions on their upper surfaces so that the latch lugs 72' are cammed into a secure fit with the tongues 68' when the support member 52' is rotated in a clockwise direction. Once the member 52' has been rotated to clear the lugs 72' for engagement with the tongues 68' the support member may simply be lifted vertically from its position on the centerpost housing. The filter ring 170 is thus free to be lifted from its notched portion 172 allowing the filter bag 52' to be lifted vertically from the hollow or cavity 55' of the agitator housing.

It will be appreciated that in both embodiments of the invention the washer drive means operates to rotate the inner tub or spin basket 18 and agitator 20 with respect to the water container 16 during a spin cycle after the contaminants, such as a lint wad, have been deposited in the mesh bag 54. The resulting movement of the elongated open top mesh bag with the rotation of the agitator centrifuges the line wad to a damp-dry condition.

The fact that the filter bag fine mesh side walls are continuously being self-cleaned by the constant shaking of the bag enables applicants to use a fine mesh bag in combination with a washing system having a very high flow recirculating pump. It will be noted that in tests conducted with applicants' disclosed embodiments and employing recirculating pumps having flow rates of the order of 12 to 20 gallons per minute resulted in the fine mesh filter bags effectively filtering out even the smallest lint particles without clogging the bags. In counterdistinction systems using a stationary fine mesh bag, as in the aforementioned Smith U.S. Pat. No. 3,769,818 for example, with comparable high flow rates resulted in the filter bags having to be cleaned out at more frequent intervals depending upon the condition of the water being recirculated.

While the embodiments of the present invention as herein disclosed constitute preferred forms, it is to be understood that other forms might be adopted.

We claim:

1. In an automatic clothes washing machine having a rotatable, perforate inner tub including a hollow open-top rotatable and vertically reciprocable agitator, a nonrotatable imperforate outer tub surrounding said inner tub and adapted to receive washing liquid from said inner tub, said outer tub having an outlet for removing washing liquid and a top access opening exposing the open-top of said agitator and through which clothes may be loaded into the washing liquid in said inner tub, a pump associated with said access opening and said outlet and operable for recirculating liquid to said inner tub through a hose end adjacent the open-top of said agitator, and drive means to reciprocate said agitator for washing said clothes while the pump is recirculating fluid, the improvement for removing and aggregating solid contaminants from recirculating liquid comprising a filter assembly having a support manually removably fastened to the open-top of said agitator for movement therewith, and an elongated mesh bag carried by said support and depending into the hollow of said agitator, said mesh bag having sidewall and bottom wall portions adapted during recirculation to hang above the level of washing liquid in the hollow of said agitator, and spray means on said hose end adapted to receive recirculating liquid from said hose end and configured to straighten and soften the flow of said recirculating liquid to prevent the aeration thereof while directing said flow through said mesh bag as said agitator reciprocates thereby to remove contaminants from the recirculating liquid by depositing said contaminants on the inside of said sidewall, the shaking of said bag effected by the reciprocation of said agitator and the flow of said recirculating water through said mesh bag cooperating to force and flush the deposited contaminants downwardly thereby to self-clean said sidewall of said contaminants while compacting said contaminants into a wad in the bottom wall portion of said bag for easy manual disposal thereof through the open-top of said agitator.

2. In an automatic clothes washing machine having a rotatable, perforate inner tub including a hollow open-top rotatable and vertically reciprocable agitator, a nonrotatable imperforate outer tub surrounding said inner tub and adapted to receive washing liquid from said inner tub, said outer tub having an outlet for removing washing liquid and a top access opening exposing the open-top of said agitator and through which clothes may be loaded into the washing liquid in said inner tub, a pump associated with said access opening and said outlet and operable for recirculating liquid to said inner tub through a hose end adjacent the open-top of said agitator, and drive means to reciprocate said agitator for washing said clothes while the pump is recirculating fluid, the improvement for removing and aggregating solid contaminants from recirculating liquid comprising a filter assembly having a support manually removably fastened to the open-top of said agitator for movement therewith, and an elongated mesh bag carried by said support and depending into the hollow of said agitator, said mesh bag having sidewall and bottom wall portions adapted during recirculation to hang above the level of washing liquid in the hollow of said agitator, and spray means on said hose end adapted to receive recirculating liquid from said hose end and configured to straighten and soften the flow of said recirculating liquid to prevent the aeration thereof while directing said flow through said mesh bag as said agitator reciprocates thereby to remove contaminants from the recirculating liquid by depositing said contaminants on the inside of said sidewall, the shaking of said bag effected by the reciprocation of said agitator and the flow of said recirculating water through said mesh bag cooperating to force and flush the deposited contaminants downwardly thereby to self-clean said sidewall of said contaminants while compacting said contaminants into a wad in the bottom wall portion of said bag for easy manual disposal thereof through the open-top of said agitator, and said drive means rotating said inner tub and said agitator after the contaminants have been deposited in said mesh bag, the movement of said mesh bag with the rotation of said agitator centrifuging said wad to a damp-dry condition.

3. In an automatic clothes washing machine having a rotatable, perforate inner tub including a hollow open-top rotatable and vertically reciprocable agitator, a nonrotatable imperforate outer tub surrounding said inner tub and adapted to receive washing liquid from said inner tub, said outer tub having an outlet for removing washing liquid and a top access opening exposing the open-top of said agitator and through which clothes may be loaded into the washing liquid in said inner tub, a pump associated with said access opening and said outlet and operable for recirculating liquid to said inner tub through a hose end adjacent the open-top of said agitator, and drive means to reciprocate said agitator for washing said clothes while the pump is recirculating fluid, the improvement for removing and aggregating solid contaminants from recirculating liquid comprising a filter assembly having a support manually removably fastened to the open-top of said agitator for movement therewith, and an elongated mesh bag carried by said support and depending into the hollow of said agitator, said mesh bag having sidewall and bottom wall portions adapted during recirculation to hang above the level of washing liquid in the hollow of said agitator, and spray means on said hose end adapted to receive recirculating liquid from said hose end and configured to straighten and soften the flow of said recirculating liquid to prevent the aeration thereof while directing said flow through said mesh bag as said agitator reciprocates thereby to remove contaminants from the recirculating liquid by depositing said contaminants on the inside of said sidewall, said bag effected by the reciprocation of said agitator and the flow of said recirculating water through said mesh bag causing said bag to fold upon itself along its vertical axis during each stroke of said agitator, whereby the resultant shaking of said bag together with the flow of recirculating water therethrough cooperating to force and flush the deposited contaminants downwardly thereby to self-clean said sidewall of said contaminants while compacting said contaminants into a wad in the bottom wall portion of said bag for easy manual disposal thereof through the open-top of said agitator, and wherein said mesh bag is detachable from said support for service replacement thereof.

* * * * *